US005542186A

United States Patent [19]

Saunders

[11] Patent Number: 5,542,186

[45] Date of Patent: Aug. 6, 1996

[54] CLEAR VIEW PEEP SIGHT FOR ARCHERY BOW

[75] Inventor: Charles A. Saunders, Columbus, Nebr.

[73] Assignee: Saunders Archery Co., Columbus, Nebr.

[21] Appl. No.: 347,682

[22] Filed: Dec. 1, 1994

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 3,859,733 | 1/1974 | Chesnick | 33/265 |
| 4,454,857 | 6/1984 | Miller et al. | 33/265 |
| 4,563,821 | 1/1986 | Saunders | 33/265 |
| 4,625,422 | 12/1986 | Carlson | 33/265 |
| 4,625,625 | 5/1982 | Carella | 33/265 |
| 4,860,458 | 8/1989 | Ernstsen | 33/265 |
| 5,056,498 | 10/1991 | Scherz | 33/265 |
| 5,148,603 | 9/1992 | Beutler | 33/265 |
| 5,347,976 | 9/1994 | Saunders | 33/265 |
| 5,379,747 | 1/1995 | Morris et al. | 33/265 |

*Primary Examiner*—Thomas B. Will
*Attorney, Agent, or Firm*—Michael G. Berkman

[57] ABSTRACT

A peepsight device for mounting on the bowstring of an archery bow. The device is characterized in that it includes a skeletal ring and an interiorly-mounted transversely-extending frame. The frame demarks and defines a peepsight orifice. Zonal areas on either side of the frame delineate, in conjunction with the circumscribing skeletal ring, fields for viewing general target areas contiguous to a peep-orifice-correlated primary target. Thus, the ease of sighting and acceleration of the sighting process itself are enhanced. Wedge-like structures integrally formed with and extending rearwardly of the ring and of the frame define vertical walls against which divided strands of the bowstring bear frictionally, and open ended slots in which the traversing bowstring strands are trained and restrained.

8 Claims, 2 Drawing Sheets

CLEAR VIEW PEEP SIGHT FOR ARCHERY BOW

FIELD AND BACKGROUND OF THE INVENTION

The present invention relates to peep sights or string-mounted bow sights for an archery bow. More particularly, the invention is directed to a light-weight peep sight which includes framing elements demarking expansive target viewing zones at either side of and above and below the peep sight aperture.

The prior art is replete with bowstring-mounted peep sights for improving accuracy in the use of archery equipment. In many of the available peep sights difficulty is experienced because the relatively small peep sight orifice or aperture makes it difficult for the archer quickly to locate either a bow-mounted front sight or a general forward target area or field.

Another problem posed by peep sights presently being marketed is that excessive thickness of the body through which the peep orifice extends has the effect of reducing the effective open cross section when the sight is angled as occurs when the bow is drawn. Through visibility is impaired.

In some arrangements this problem has been dealt with by boring the sight opening or orifice at an angle relative to the bowstring so that alignment is achieved when the bow is fully drawn.

Others of the peep sights of the prior art are objectionably heavy, thus adding extra drag, slowing the bowstring speed, and interfering with accurate arrow flight.

The typically small diameter or opening size in peep sights makes it difficult for the archer to locate the target, to keep his eye on the target, and prevents the archer from easily and quickly relocating his target. Under reduced or dim light conditions many peep sights are rendered unusable since the restricted opening unduly limits the amount of useful light passing through the small bore.

Accordingly, it is a principal aim of the invention to provide an improved peep sight including improved means for more effectively and more rapidly identifying the field in which the target itself lies. The peep sight is characterized by its thin skeletal structure, and by its reduced mass, thus minimizing drag and interference with the mechanics of the bowstring, and obviating other shortcomings of prior art devices of the type finding utility in the field in which the present invention lies.

SUMMARY OF THE INVENTION

The improved peep sight of the present invention is characterized in that it provides, in conjunction with and for cooperation with a peep orifice or peep aperture, an enveloping frame demarking general target viewing areas embracing the centrally located peep sight bore or aperture. The device of the invention includes a thin, flat ring in combination with a panel-like bridging web or frame which extends within and diametrically across the ring itself. The frame or web supports a pair of spaced upper and lower block-like or wedge-like bowstring guides or blocks about which divided strands of a bowstring are trained. The through peep orifice is formed in the web, and is centered in the ring.

It is an important feature of the peep sight of the invention that it is fabricated of plastics material in a single molding process to form a thin-walled and narrow band-width ring.

A related feature of the device is the inclusion of a transverse web, band or frame integrally formed with the ring and extending diametrically thereacross.

An important feature of the mechanical structure is that the peep sight orifice or aperture is formed to extend through the transverse web and that the web is exceedingly thin in the zone in which the aperture is found.

Yet another feature of the peep sight assembly of the invention is the provision of block-like wedges, integrally formed with the ring and the transverse web and supported thereon at opposed end zones of the web or transverse frame.

A related featured is that the blocks are integrally formed with flanges which project laterally of opposed sides of the blocks and rearwardly thereto to form, in further cooperation with the web and the ring, slots or guide channels in which strands of a divided bowstring are confined or retained.

In a preferred embodiment of the invention thr wedge-like, bowstring-dividing blocks include opposed side sections which taper or converge inwardly in a direction toward the bounding peripheral ring of the assembly.

It is a feature of the peep sight of the invention that the areal zone of the web in which the peep orifice is located is exceedingly thin, minimizing the extent to which the area of the orifice suffers reduction as the angular disposition of the peep sight changes when the bowstring is drawn.

An important feature of the present invention is that the target view is unobstructed. Complete peripheral vision capability is assured.

The peep sight is fabricated of a non-glare plastics material formed as a high-strength polymer.

Other and further advantages of the present invention will be evident from the following detailed description considered in conjunction with the drawings.

DESCRIPTION OF ILLUSTRATED EMBODIMENT

Figure 1:
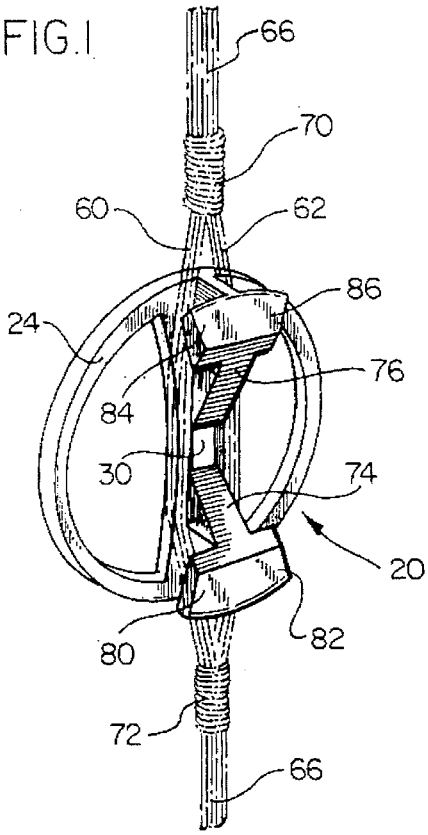
FIG. 1 is a rear perspective view of a bowstring-mounted peep sight according to the present invention, embodying the features thereof.
Figure 2:
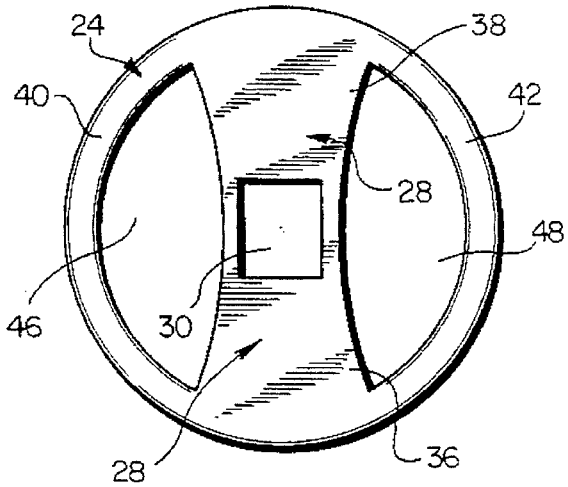
FIG. 2 is a front elevational view of the peep sight showing the ring and the diametrically carried frame, and also showing the peep sight orifice as well as the framed general target-viewing openings.

The aims and objects of the present invention are achieved by providing, in combination in a bow-string mounting sighting device a peep sight assembly which includes a ring which delineates a target field viewing area, a ring-carried web or frame extending diametrically across the ring and formed at its center and at the center of the ring with a restricted peep aperture or orifice. The transverse web is integrally formed, above and below the peep orifice, with upper and lower wedge-like block including laterally extending rear flanges, all defining, with the ring, laterally open slots at either side of the web, in which divided strands of the bowstring are seated and confined or restrained. The ring defines a narrow band and is thin, as is the frame or web, effectively reducing the overall mass of the assembly and minimizing adverse effects on the functioning of the bowstring when drawn and released.

The peep sight assembly is held on the bowstring by friction and by pressure derived from the tensioned, divided strands of the bowstring which traverse the channels or slots at either side of the web or frame. Positive and firm securement is enhanced and ensured by serving applied above and below the selectively positioned peep sight assembly.

Referring now to the drawings, and particularly to FIGS. 1 through 4, for purposes of disclosure and not in any limiting sense, a preferred embodiment of the invention is shown as comprising a bowstring mounted peep sight assembly 20 including thin-walled, skeletal, narrow width ring 24, and a coplanar frame or web 28 extending diametrically across the ring interiorly thereof. The web 28 is formed, at a center zone thereof with a through opening constituting a peep sight orifice or aperture 30 bounded laterally by spaced web walls 32.

In a preferred embodiment of the invention the web 28 is narrow at its mid section 34 and is flared outwardly at each of its lower and upper end portions 36 and 38 where the web 28 joins the ring 24. At either side of the web 28 and bounded by or framed by the side sectors 40 and 42 of the ring 24 are enlarged viewing zones 46 and 48 through which the more general target area may be viewed or sighted by the archer. The physical arrangement shown enables the archer quickly and easily to relocate the broader target area without losing visual coordination with the peep sight orifice.

Figure 3:
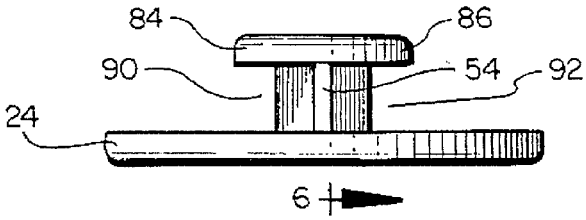
FIG. 3 is a top plan view of the peep sight showing the string divided and the restraining flanges, and laterally spaced guide slots in which the divided strands of the bowstring seat.
Figure 4:
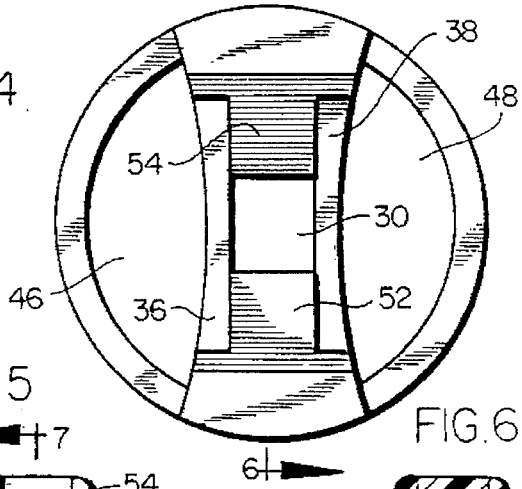
FIG. 4 is a rear elevational view of the peep sight of the invention.
Figure 7:
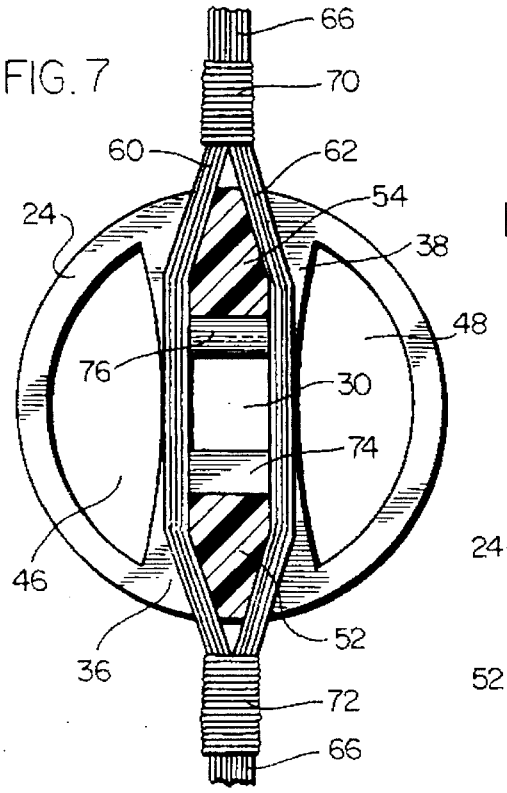
FIG. 7 is a cross-sectional view taken substantially on the lines 7—7 of FIG. 5 and showing the divided bowstring strands embracing the upper and lower wedge-like divider walls carried by the ring-supported frame or web.
Figure 5:
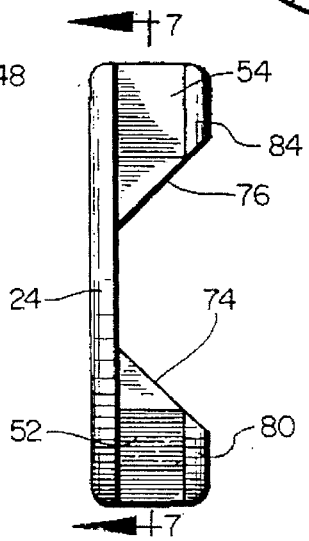
FIG. 5 is a side elevational view of the peep sight with the bowstring strands eliminated for clarity.
Figure 6:
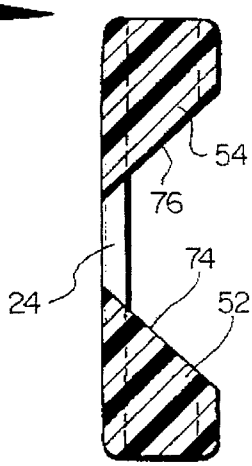
FIG. 6 is a cross-sectional view taken substantially on the lines 6—6 of FIG. 4.

As shown in FIG. 1 and in FIGS. 3–7, the frame or web 28 is integrally formed on its rear face and extending normally thereof with a pair of block-like upper and lower wedges or guides 52 and 54 at lower and upper end zones of the web 28. The blocks 52 and 54 constitute structures for frictionally engaging divided strands 60 and 62 of a tensioned bowstring 66. As best seen in FIG. 7, by their outwardly directed end zones the blocks or wedges 52 and 54 are tapered inwardly so as to minimize divergence of the separated bow strands 60 and 62 as the strands leave the peep sight assembly 20. Serving 70 and 72, above and below the assembly 20 ensures positive securement and physical stability. As shown in FIGS. 1 and 5 and 6, the rear faces 74 and 76 of the guides 52 and 54 are cut away to reduce the mass of the assembly 20.

As evident in FIGS. 3 and 4, and as shown in FIG. 1, wing-like flanges 80 and 82 and 84 and 86 are integrally formed with the respective wall-like, string-dividing wedges 52 and 54. The flanges project laterally of and outwardly of the wedges 52 and 54 and define, in cooperation and in conjunction with the ring 24, the web 28, and the walls 52 and 54, channel-like slots 90 and 92 in which the divided bowstring strands 60 and 62 are received, trained and retained.

Figure 8:
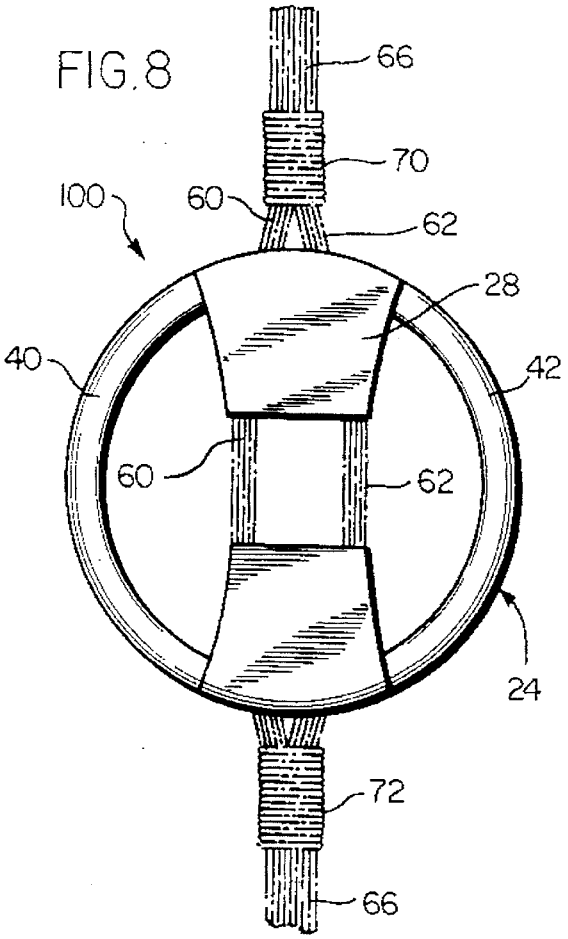
FIG. 8 is a front elevational view of a second embodiment of a bowstring-mounted peep sight according to the present invention in which side framing members of the peep sight aperture have been eliminated, further to avoid obstructions to the archer's peripheral vision.
Figure 9:
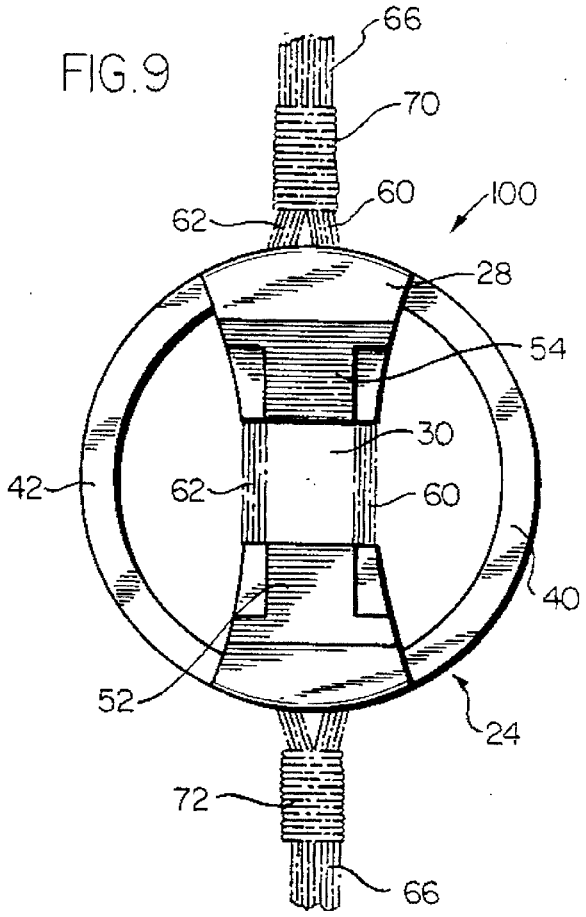
FIG. 9 is rear elevational view of the peep sight of FIG. 8.

A second, somewhat modified embodiment 100 of the peep sight of the invention, is shown in FIGS. 8 and 9. The framing members 32 at each side of the peep sight orifice 30, and connecting the upper and lower blocks 54 and 52 of the web 28 have been eliminated further to obviate interference with the peripheral vision of the archer.

Figure 10:
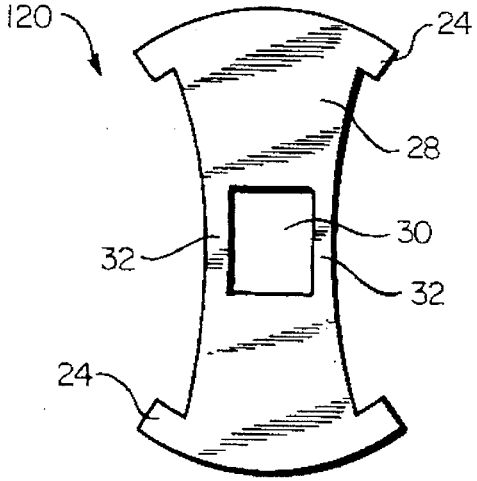
FIG. 10 is a front elevational view of a third embodiment of the peep sight of the invention, in which the framing arcuate side sections have been cut away eliminating them as obstructions interfering with the archer's peripheral viewing.
Figure 11:
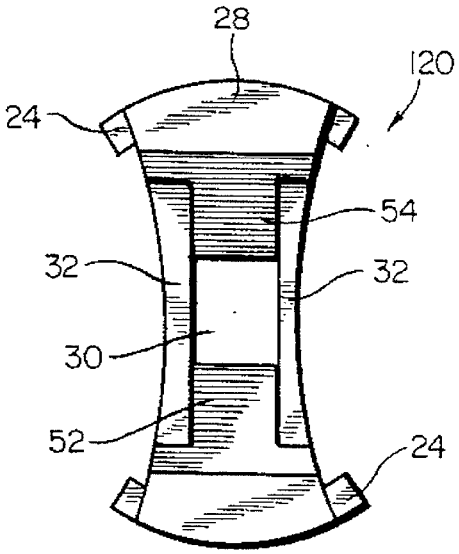
FIG. 11 is a rear elevational view of the peep sight of FIG. 10.

FIGS. 10 and 11 are front and rear elevational views depicting a third embodiment 120 of the invention. As shown, this embodiment differs from that shown in FIGS. 1 through 7 in that the arcuate side sections 40 and 42 of the ring 24 have been eliminated, thus removing a further mechanical structure which might interfere with an archer's peripheral viewing of the target zone.

It will be appreciated that the ring means of the invention, with interruptions or with arcuate sections cut away, as well as the bridging frame with a mid section cut away, contributes toward effectuating the aim of the invention to ensure a minimum of impedance in viewing the broader target area and in sighting on the target itself.

What is claimed is:

1. A peepsight for mounting on a bowstring of an archery bow, said peepsight comprising ring means for supporting frame means, said frame means extending across and being circumscribed by said ring means for delineating a centrally disposed peepsight orifice, said ring means and said frame means demarking enlarged, broader target area viewing zones to either side of and above and below an actual target viewing zone framed by said peep sight orifice, a pair of block-like bowstring guide means supported on said frame means at longitudinally spaced upper and lower areal end zones of said frame means for physically separating, and for frictionally engaging divided and tensioned strands of a bowstring trained about and traversing said guide means.

2. A peep sight as set forth in claim 1 wherein said ring means and said frame means are essentially coplanar and overlie said bowstring guide means extending rearwardly thereof and normally thereto.

3. A peepsight as set forth in claim 2 and further comprising flange means integrally formed with said bowstring guide means and projecting outwardly of opposed sides of each of said pair of said bowstring guide means for restrictively confining divided strands or the bowstring and for obviating dislodgement of bowstring strands engaging said bowstring guide means.

4. A peep sight as set forth in claim 1 wherein respective said block-like guide means include radially outwardly directed sections tapering inwardly in a direction toward a bounding said ring means.

5. A peepsight for mounting on a bowstring of an archery bow, said peepsight comprising a skeletal ring means for supporting frame means, said frame means being integrally formed with and generally coplanar with said ring means and bridging vertically across said ring means for framing, in a mid-zonal area of said frame means, a peep orifice for sighting a target therethrough, said ring means in conjunction with said frame means demarking laterally spaced broader field viewing zones at each of opposed sides of said frame means and within pounds of said ring means, wedge-like wall means integrally formed with and extending rearwardly of said frame means at under surfaces thereof at opposed longitudinally-spaced upper and lower end zones of said frame means for separating and for frictionally engaging divided strands of a bowstring bridging and traversing outer sides or each said wall means, and flange means integrally formed with each of said wall means and joined to extend normally of and outwardly at each of opposed said outer sides of said wall means and spaced rearwardly of said ring means for confining, between said ring means and each of said flange means, divided strands or a bowstring traversing and frictionally stressing opposed said sides of each of said wall means.

6. A peepsight as set forth in claim 5 wherein each of said wall means tapers inwardly in a direction toward a bounding, circumscribing said ring means.

7. A peep sight as set forth in claim 5 wherein said frame means includes a pair of side walls at a mid-zonal area of said frame means and connected to opposed lateral sides of said wedge-like wall means, said side walls defining and demarking lateral limits of said peep sight orifice.

8. A peep sight as set forth in claim 5 wherein said frame means bridging said ring means includes a discontinuity in a mid-zonal area thereof, said discontinuity rendering the peep sight orifice open laterally and devoid of lateral physical bounding walls, and obviating interference with an archer's peripheral viewing of a target zone.

* * * * *